US008359796B1

(12) United States Patent
Plummer et al.

(10) Patent No.: US 8,359,796 B1
(45) Date of Patent: Jan. 29, 2013

(54) DUAL SUPPORT CONNECTOR ASSEMBLY FOR DOORS AND WINDOWS

(75) Inventors: John B. Plummer, Houston, TX (US); Joseph Gene Denley, Cypress, TX (US)

(73) Assignee: Glasscraft Door Company, Houston, TX (US)

( * ) Notice: Subject to any disclaimer, the term of this patent is extended or adjusted under 35 U.S.C. 154(b) by 0 days.

(21) Appl. No.: 13/533,762

(22) Filed: Jun. 26, 2012

(51) Int. Cl.
*E06B 3/964* (2006.01)

(52) U.S. Cl. ..... 52/204.61; 52/204.62

(58) Field of Classification Search ..... 52/204.5, 52/204.53, 204.54, 204.55, 204.6, 204.61, 52/204.62, 204.64, 204.65, 204.67, 204.68, 52/204.69, 204.71, 204.72, 208
See application file for complete search history.

(56) References Cited

U.S. PATENT DOCUMENTS

| | | | | | |
|---|---|---|---|---|---|
| 3,750,358 | A | | 8/1973 | Lewkowitz | |
| 3,760,543 | A | | 9/1973 | McAllister | |
| 3,903,669 | A | | 9/1975 | Pease, Jr. et al. | |
| 4,021,967 | A | | 5/1977 | Mulder et al. | |
| 4,246,731 | A | | 1/1981 | Miro | |
| 4,720,951 | A | | 1/1988 | Thorn et al. | |
| 4,735,025 | A | | 4/1988 | Day | |
| 4,920,718 | A | | 5/1990 | Artwick et al. | |
| 4,947,597 | A | * | 8/1990 | Simpson | 52/208 |
| 5,018,330 | A | * | 5/1991 | Lewkowitz | 52/455 |
| 5,133,168 | A | | 7/1992 | Neilly et al. | |
| 5,249,403 | A | | 10/1993 | Neilly et al. | |
| 5,570,548 | A | | 11/1996 | Hopper | |
| 5,577,355 | A | * | 11/1996 | Leonelli | 52/204.62 |
| 5,634,508 | A | | 6/1997 | Herbst | |
| 5,644,881 | A | | 7/1997 | Neilly | |
| 5,749,184 | A | * | 5/1998 | McKann | 52/204.1 |
| 5,765,325 | A | * | 6/1998 | DeBlock | 52/204.5 |
| 5,894,706 | A | | 4/1999 | Herbst | |
| 6,151,849 | A | * | 11/2000 | Twigg et al. | 52/208 |
| 6,272,801 | B1 | | 8/2001 | Suh | |
| 6,318,037 | B1 | * | 11/2001 | Hansen | 52/208 |
| 6,546,682 | B1 | * | 4/2003 | DeBlock et al. | 52/204.72 |
| 6,553,735 | B1 | * | 4/2003 | Wang Chen | 52/455 |
| 6,574,935 | B2 | | 6/2003 | Wang et al. | |
| 6,609,338 | B2 | * | 8/2003 | Hightower | 52/204.65 |
| 6,672,021 | B2 | * | 1/2004 | Kusano et al. | 52/211 |
| 6,694,701 | B2 | | 2/2004 | Wang et al. | |
| 6,715,245 | B2 | * | 4/2004 | Lewkowitz | 52/208 |
| 6,925,767 | B2 | | 8/2005 | Krochmal et al. | |
| 7,448,174 | B2 | | 11/2008 | Krochmal et al. | |
| D613,878 | S | | 4/2010 | Walsh et al. | |
| D625,838 | S | | 10/2010 | Walsh et al. | |
| 2003/0000163 | A1 | * | 1/2003 | Lamanna | 52/204.62 |
| 2003/0041539 | A1 | | 3/2003 | Bernacki et al. | |
| 2003/0056442 | A1 | | 3/2003 | Gerard | |

(Continued)

*Primary Examiner* — Joshua J Michener
*Assistant Examiner* — Keith Minter
(74) *Attorney, Agent, or Firm* — Buskop Law Group, PC; Wendy Buskop

(57) ABSTRACT

A dual support connector assembly for connecting a glass panel, including an insulated glass panel a security glass panel, or a decorative leaded glass panel, to a structural panel for a door or a window without creating holes in the door or glass panel wherein the connector has a connector body, connector hole extending through the connector body, a lower glass flange integral with the connector body for overlaying an edge portion of the glass panel; an upper structural panel flange integral with the connector body, extending at an angle to the connector hole away from the connector body parallel to while opposite the lower glass panel flange for overlaying an edge portion of the structural portion while in a plane apart from a plane of the lower glass flange.

14 Claims, 10 Drawing Sheets

U.S. PATENT DOCUMENTS

2004/0144046 A1* 7/2004 Wang et al. ..... 52/204.1
2007/0193140 A1* 8/2007 Carnick et al. ..... 52/208
2008/0245003 A1* 10/2008 Kon et al. ..... 52/208
2010/0064625 A1 3/2010 Charlton et al.
2011/0113706 A1* 5/2011 Krause ..... 52/204.5
2011/0239560 A1* 10/2011 Landeros ..... 52/204.61

* cited by examiner

FIGURE 10A
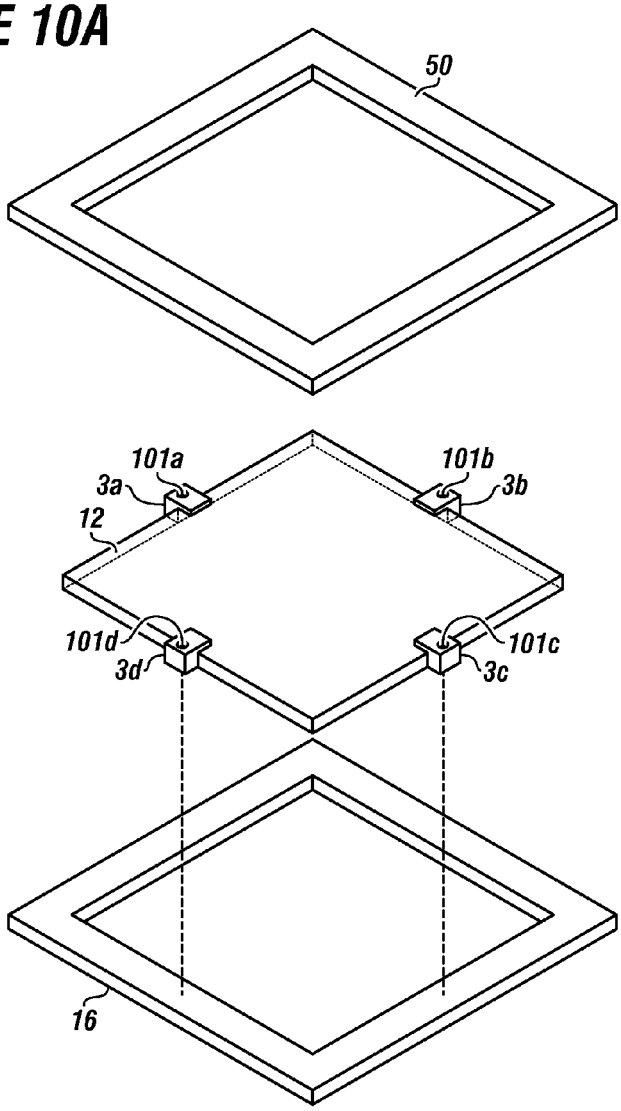
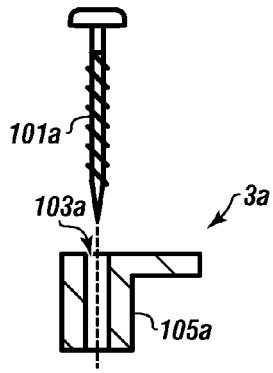
FIGURE 10B

DUAL SUPPORT CONNECTOR ASSEMBLY FOR DOORS AND WINDOWS

FIELD

The present embodiments generally relate to a dual support connector for connecting glass panels with structural portions of doors or windows.

BACKGROUND

A need exists for a dual support connector that can hold a glass panel to a structural panel of a door in a concealed manner that is quick to install, easy to use, and requires no training.

A need exists for a dual support connector that allows a retrofit of existing doors and windows for better insulation, to save on the use of fossil fuels and associated energy costs.

A need exists for a dual support connector that allows a retrofit of existing doors and windows to provide greater levels of safety in the home for children and senior citizens.

A further need exists for a lightweight, rust resistant, dual support connector that can be hidden within the door, presenting a strong but attractive appearance without forming holes in the existing doors or windows.

The present embodiments meet these needs.

BRIEF DESCRIPTION OF THE DRAWINGS

The detailed description will be better understood in conjunction with the accompanying drawings as follows:

FIG. 10A depicts a kit created to retrofit a glass panel into a door already installed at a field location, such as at a house, at a chemical plant, at a retail establishment.

FIG. 10B depicts an isometric view of a shipping clip and a shipping fastener usable with the kit.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that they can be practiced or carried out in various ways.

The dual support connector assembly can be used to form a door assembly or window assembly that positions glass into a door safely and efficiently either in the field, on an installed door, or in a factory that builds new doors. In embodiments, the door assemblies can use doors composed of fiberglass, steel, or composite materials.

The dual support connector assembly can allow the glass of the door to be easily replaced without special tools.

The dual support connector assembly can allow lower costs for a door manufacturer by not requiring the additional labor to form edge flanges in the opening of the door.

The dual support connector assembly can allow the glass in a door to be mounted without any visible mounting holes formed in the door face or an insert frame.

The dual support connector assembly can allow a window frame assembly to be installed without visible screw holes through the use of a dual support connector to hold the frames into the window.

The dual support connector assembly can help the American economy because the consumer will be able to fix existing broken frames in doors and windows or replace glass that is not energy efficient, without buying a new door and without a significant time investment.

The dual support connector assembly can provide a window assembly that can be easily disassembled for broken glass replacement, having an integral alignment system that allows the frames holding the replacement glass to be easily and properly aligned.

Figure 1:
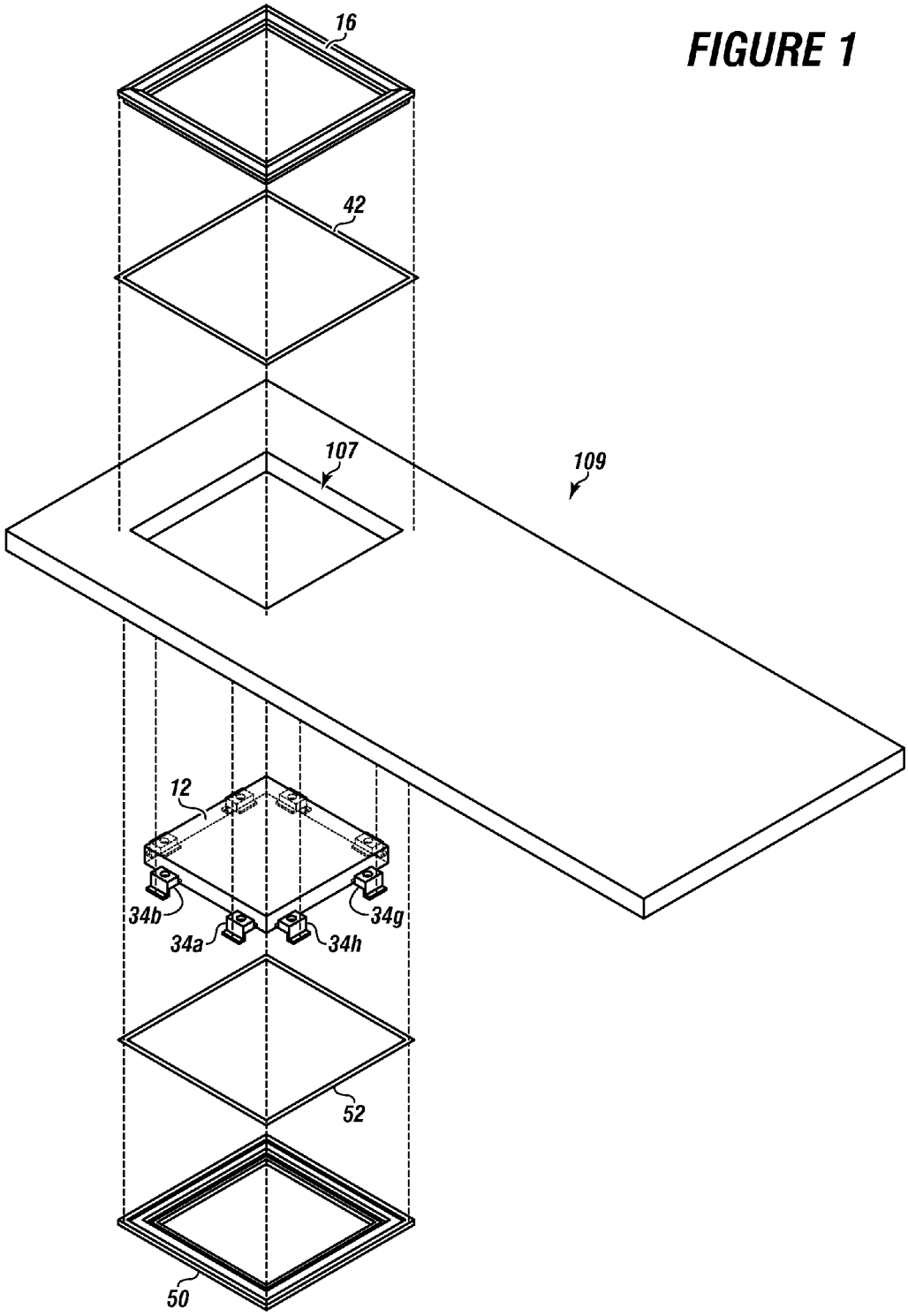
FIG. 1 depicts an assembly schematic of a door assembly formed using a dual support connector assembly.

Turning now to the Figures, FIG. 1 depicts an assembly schematic of a door assembly formed using a dual support connector assembly.

A door 109 can have an opening 107. An exterior frame 16 can be disposed about the opening 107.

A first seal 42 can be disposed on the exterior frame 16. The seals can be a gasket, a curable silicone sealant, a cross linked elastomer, a resin, an adhesion promoter, a natural rubber, a synthetic rubber, or combinations thereof.

A glass panel 12 can be disposed between the first seal 42 and tape 52. The glass panel 12 can be an insulated glass assembly; a single glass pane; a leaded glass insert; a stained glass insert; a security panel, such as tempered or laminated glass; or combinations of these panels.

The dual support connectors 34*a*-34*h* can be positioned over an edge of the glass panel. The dual support connectors 34*a*-34*h* can connect with the glass panel 12 and the exterior frame 16.

The interior frame 50 can be disposed about the opening 107 on a side of the door 109 opposite the exterior frame 16. For example, the interior frame 50 can be located on the side of the door 109 that faces the interior of a house when the door is shut, and the exterior frame 16 can be disposed on the side of the door 109 that faces the outside of a house when the door is shut. The interior frame 50 can be a frame or another device configured to cover all of the plurality of installed connectors and secure to the door 109 and the glass panel 12. The interior frame 50 can be similar to the exterior frame 16 in shape and appearance.

The interior frame 50 and the exterior frame 16 can be made from any structural material. Illustrative materials can include wood; metals; plastics; recycled materials, such as recycle plastic milk bottles or recycled milk carton liners; laminated materials; composite materials, such as polyvinyl chloride and sawdust composites; or combinations thereof. The interior frame 50 and the exterior frame 16 can be embossed with a decorative wood grain into the decorative face of the frame.

Figure 2:
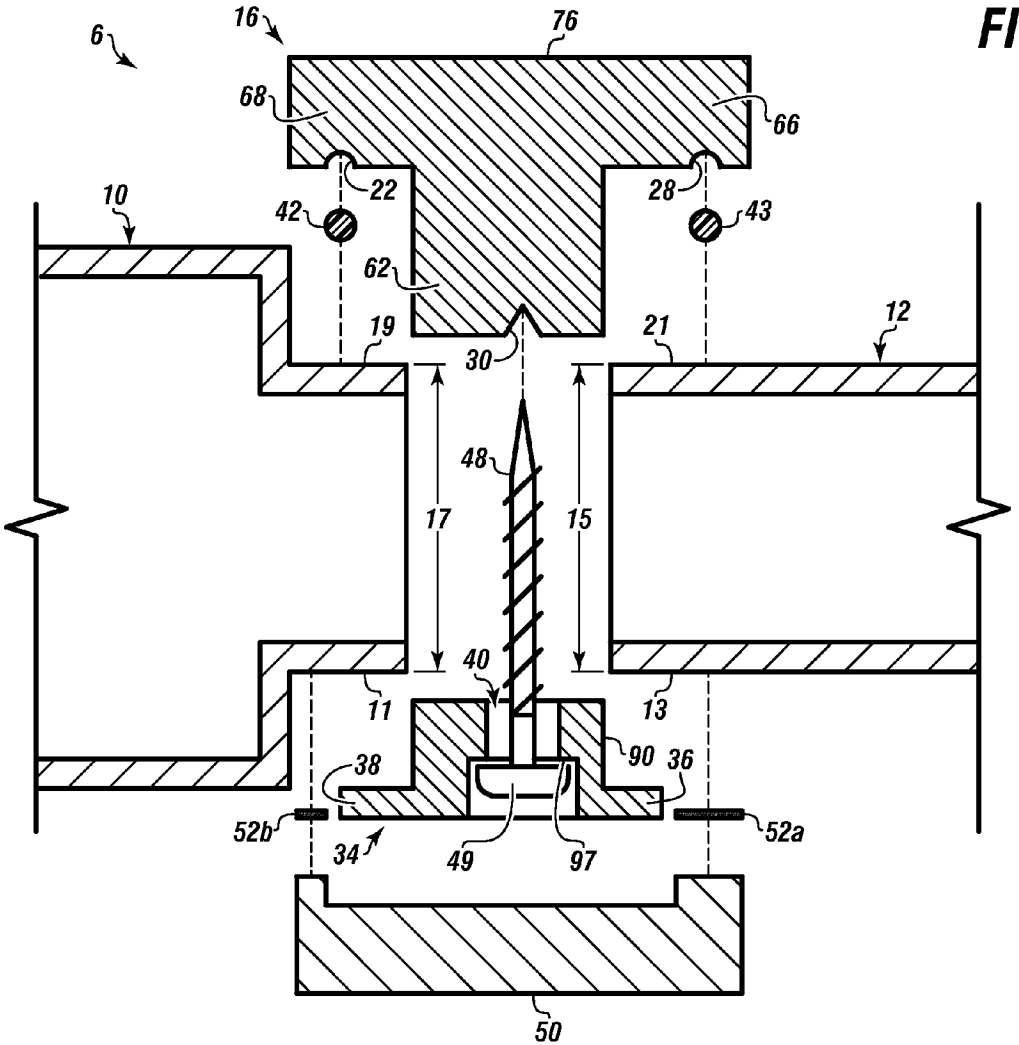
FIG. 2 depicts a detailed exploded view of the dual support connector assembly.
Figure 3:
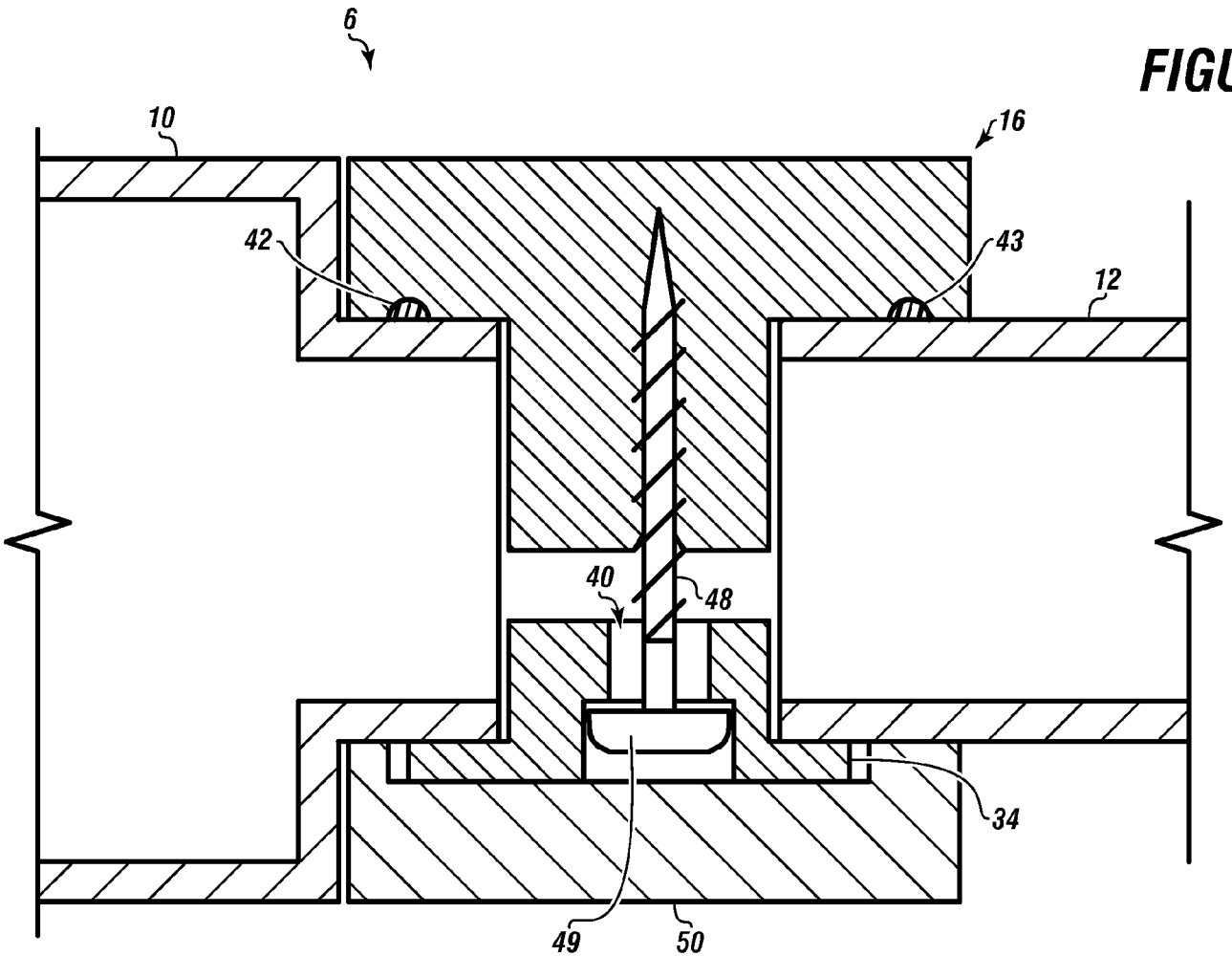
FIG. 3 depicts a detailed side view of the dual support connector assembly in an assembled configuration.

FIG. 2 depicts a detailed exploded view of the dual support connector assembly for a Craftsman style door, while FIG. 3 depicts a detailed side view of the dual support connector assembly in an assembled configuration for the same style of door.

Referring to FIGS. 2 and 3, the dual support connector assembly 6 can include the dual support connector 34. The dual support connector 34 can be used with any door. For example, the dual support connector 34 can be used with a Craftsman style door, a wood door, a Craftsman style fiberglass door, or the like. The dual support connector 34 can be disposed at least partially between the glass panel 12 and a structural panel 10.

The glass panel 12 can have a glass panel thickness 15, and the structural panel 10 has a structural panel thickness 17. The glass panel thickness 15 and the structural panel thickness 17 can be substantially similar.

The dual support connector 34 can have a connector body 90. The connector body 90 can be generally rectangular in shape.

A connector hole 40 can extend through the connector body 90. The connector hole 40 can have a connector stop 97 disposed therein for stopping a head 49 of a fastener 48 from passing through the connector body 90.

A door flange 38 can be integral with the connector body 90. The door flange 38 can extend at a right angle to the connector hole 40 away from the connector body 90 for overlaying a panel edge portion 11 of the structural panel 10. The structural panel can be a portion of the door. For example, the structural portion for a door would be the portion of the door surrounding the opening into which the glass panel 12 is affixed.

A glass flange 36 can be integral with the connector body 90 and can extend at a right angle to the connector hole 40 away from the connector body 90. The glass flange 36 can overlay a glass edge portion 13 of the glass panel 12.

The door flange 38 and the glass flange 36 can have a thickness from about 0.5 mm to about 6 mm.

The interior frame 50 can cover all the connectors simultaneously while connecting to the panel edge portion 11 and the glass edge portion 13 with fastening means 52*a* and 52*b*. The interior frame 50 can be positioned over the fastener 48 and dual support connector 34. The interior frame 50 can be slightly wider than the dual support connector 34.

First fastening means 52*a* can be used to connect the interior frame 50 to the glass edge portion 13, and a second fastening means 52*b* can be used to connect the interior frame 50 to the panel edge portion 11. The fastening means can be an adhesive, double sided tape, or the like.

The exterior frame 16 can have an exterior frame body portion 62. The exterior frame body portion 62 can have a lower portion disposed between the glass panel 12 and the structural panel 10.

An alignment groove 30 can be located on the exterior frame body portion 62. The alignment groove 30 can be on the lower portion of the exterior frame body portion 62.

The fastener 48 holds the dual support connector 34 to the glass panel 12 by engaging with the alignment groove 30. The alignment groove 30 and the dual support connector 34 can be spaced apart, allowing for size variance between the glass panel and the structural portion of the door.

The fastener 48 can be a screw, nail, or a bolt. In a headless version of the fastener, the fastener can be an epoxy, a flexible adhesive, or combinations thereof. A portion of the fastener 48 can be configured to engage the connector stop 97, preventing the fastener 48 from passing entirely through the connector hole 40.

A decorative face 76 can be located on the exterior frame body portion 62.

A first gasket groove 22 and a second gasket groove 28 can be formed in the exterior frame body portion 62. The gasket grooves can be any shape. For example, the gasket grooves can be substantially U-shaped channels running the length of the exterior frame body portion 62.

The exterior frame body portion 62 can include an exterior frame door flange 68 and an exterior frame glass flange 66.

The exterior frame door flange 68 and the exterior frame glass flange 66 can extend laterally outwardly from the exterior frame body portion 62.

The exterior frame door flange 68 can be configured to engage a structural edge 19 of the structural panel 10. The exterior frame glass flange 66 can be configured to engage a glass edge 21 of the glass panel 12. The first gasket groove 22 can be formed on the exterior frame door flange 68. The second gasket groove 28 can be located on the exterior frame glass flange 66.

A first seal 42 can be disposed within the first gasket groove 22. The first seal 42 can seal against the structural edge 19.

A second seal 43 can be disposed within the second gasket groove 28. The second seal 43 can seal against the glass edge 21.

The seals can be gaskets or another sealing device. Illustrative seals can include flexible, deformable gaskets; curable silicone sealants; a cross linked elastomer; resins; adhesion promoters; a natural or synthetic rubber; or combinations of these components. The seals can be any material capable of forming a seal.

In embodiments, the dual support connector assembly can have an antistatic coating disposed on the connector, such as rubber, to reduce shocks or static build up which can affect security systems on doors which are electronic.

Figure 4A:
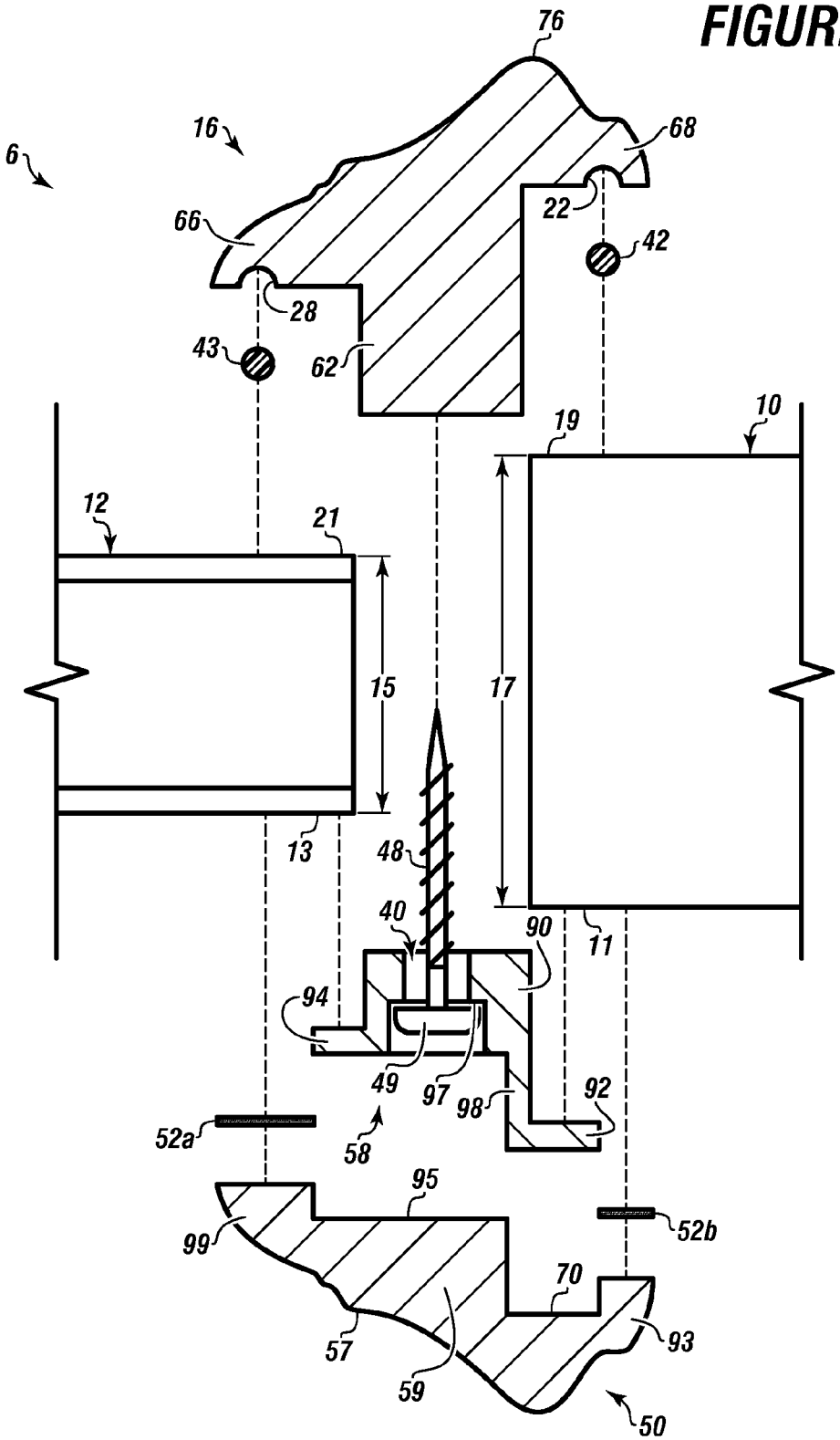
FIG. 4A depicts an exploded view of another embodiment of the dual support connector assembly.
Figure 4B:
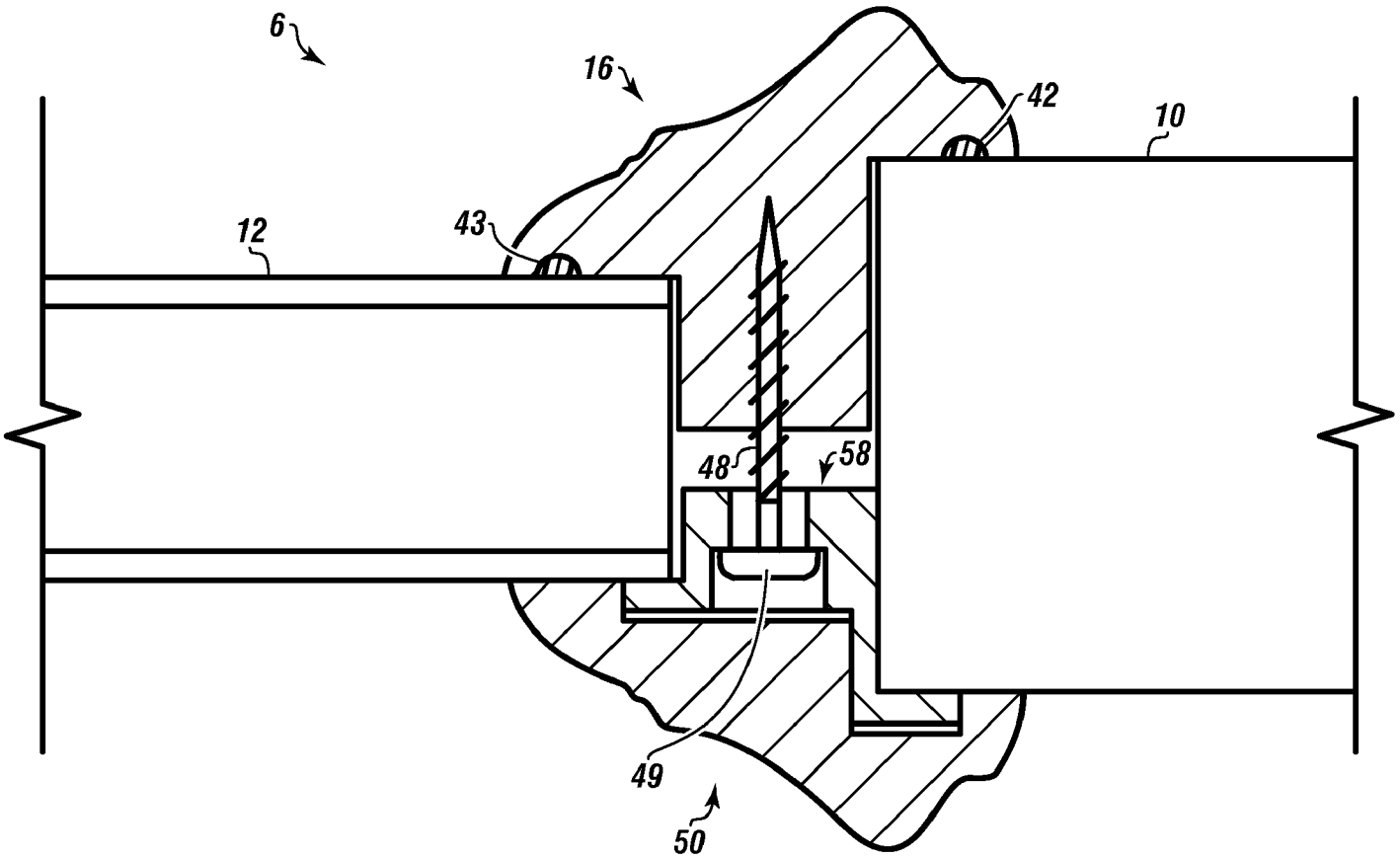
FIG. 4B is an assembled embodiment of FIG. 4A.

FIG. 4A depicts an exploded view of another embodiment of the dual support connector assembly. FIG. 4B is an assembled embodiment of FIG. 4A.

Referring to FIGS. 4A and 4B, the dual support connector assembly 6 can have a dual support connector 58.

The dual support connector 58 can include a connector body 90. The dual support connector 58 can be aluminum, wood, alloys of metal, polyurethane, blends of polyester, polyvinyl chloride (PVC), acrylonitrile butadiene styrene copolymer, polyamide, styrene butadiene rubber copolymer, or combinations thereof.

The connector hole 40 can extend through the connector body 90. A connector stop 97 can be located in the connector hole 40. The connector stop 97 can engage a head 49 of the fastener 48, preventing the head of the fastener from passing through the connector hole.

The dual support connector 58 can also include a connector glass panel flange 94 that is integral with the connector body 90. The connector glass panel flange 94 can extend at a right angle to the connector hole 40 and away from the connector body 90. The connector glass panel flange 94 can overlay the glass edge portion 13.

A connector structural panel flange 92 can be integral with the connector body 90. The connector structural panel flange 92 can extend at a right angle to the connector hole 40 away from the connector body 90. The connector structural panel flange 92 can overlay the panel edge portion 11.

The connector body 90 can include an integral flange support portion 98. The connector structural panel flange 92 can extend from the integral flange support portion 98.

The glass panel 12 can have glass panel thickness 15. The structural panel 10 can have a structural panel thickness 17. The glass panel thickness and the structural panel thickness can be unequal and can differ as much as from 5 percent to 90 percent in thickness from each other.

In embodiments, the interior frame 50 can include a connector groove 70 on an interior portion thereof for engaging the dual support connector 58.

The exterior frame 16 can include the exterior frame body portion 62. The exterior frame body portion 62 can include a decorative face 76, an exterior frame door flange 68, and an exterior frame glass flange 66.

The exterior frame glass flange 66 can be configured to abut glass edge 21, and the exterior frame door flange 68 can be configured to abut structural edge 19.

The first gasket groove 22 is formed in the exterior frame door flange 68. The second gasket groove 28 is formed in the exterior frame glass flange 66.

A first seal 42 can be disposed between the structural panel 10 and the exterior frame door flange 68 in the first gasket groove 22.

A second seal 43 can be disposed between the exterior frame glass flange 66 and the glass panel 12 in the second gasket groove 28.

The interior frame 50 can be disposed over a plurality of connectors.

Interior frame 50 can have an interior frame body 59. The interior frame body 59 can include an interior frame glass flange 99, an interior frame door flange 93, and an interior frame decorative face 57. The interior frame body 59 can also include an interior frame intermediate face 95.

A first fastening means 52*a* can be disposed on the interior frame glass flange 99. The first fastening means 52*a* can connect the interior frame 50 to the glass edge portion 13. The second fastening means 52*b* can connect the interior frame door flange 93 to the panel edge portion 11 covering all of the plurality of connectors.

Figure 5:
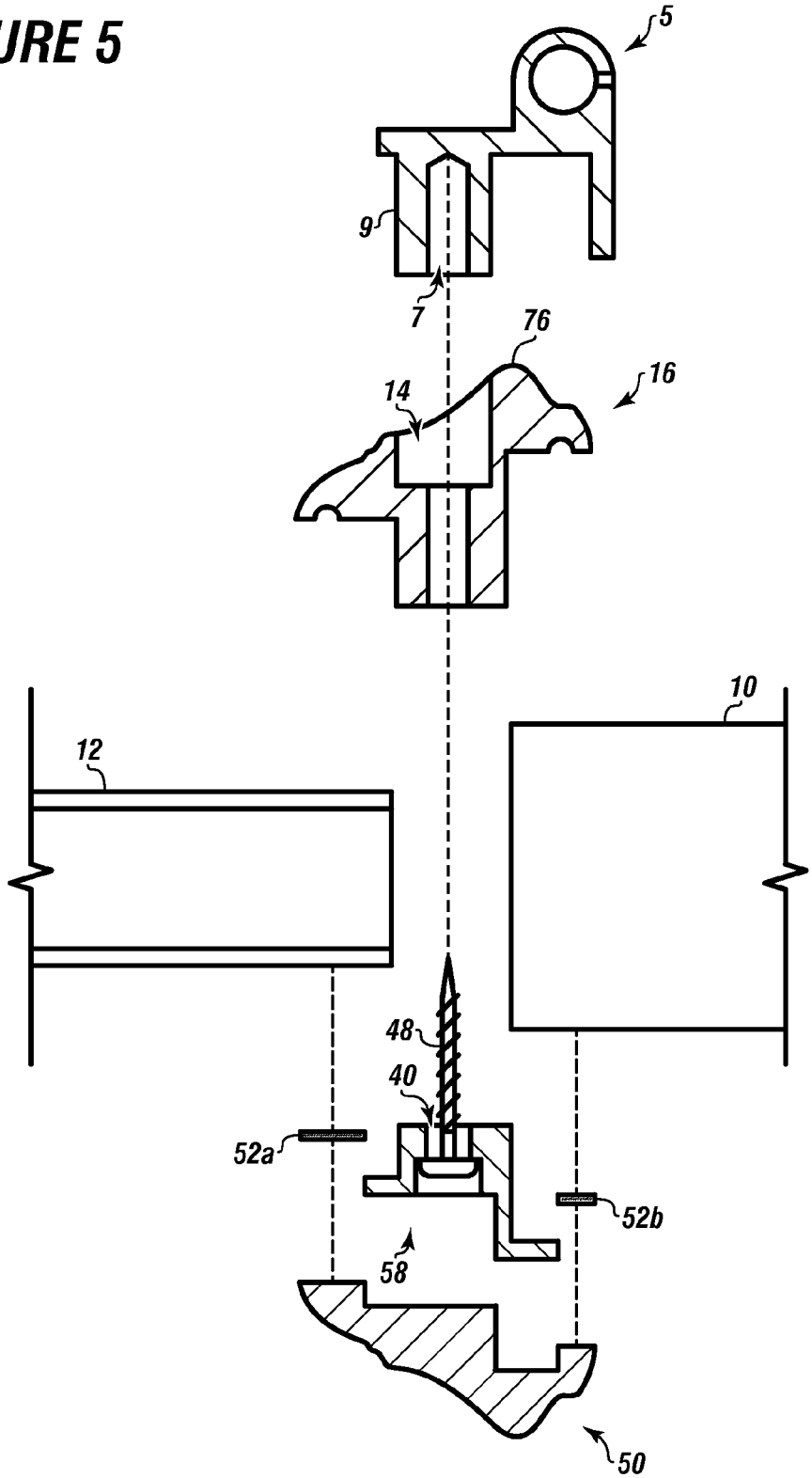
FIG. 5 depicts a detailed exploded view of a dual support connector assembly with an iron grill connector attached for security.

FIG. 5 depicts a detailed exploded view of a dual support connector assembly with an iron grill connector attachment for security.

The fastener 48 passes through the dual support connector 58 and into a grill recess 7 in a grill connector 5 after passing through the exterior frame 16.

The grill recess 7 can be formed in a grill extension 9. The exterior frame 16 can have a grill chamber 14 for receiving the grill extension 9. The grill chamber 14 can have an opening formed through the decorative face 76.

The interior frame 50 can connect to the glass panel 12 and the structural panel 10 simultaneously, via fastening means 52*a* and 52*b*.

The fastener 48 can extend through the connector hole 40 of dual support connector 58 and the exterior frame 16 and the grill connector 5. The interior frame 50 can cover the dual support connector 58.

Figure 6:
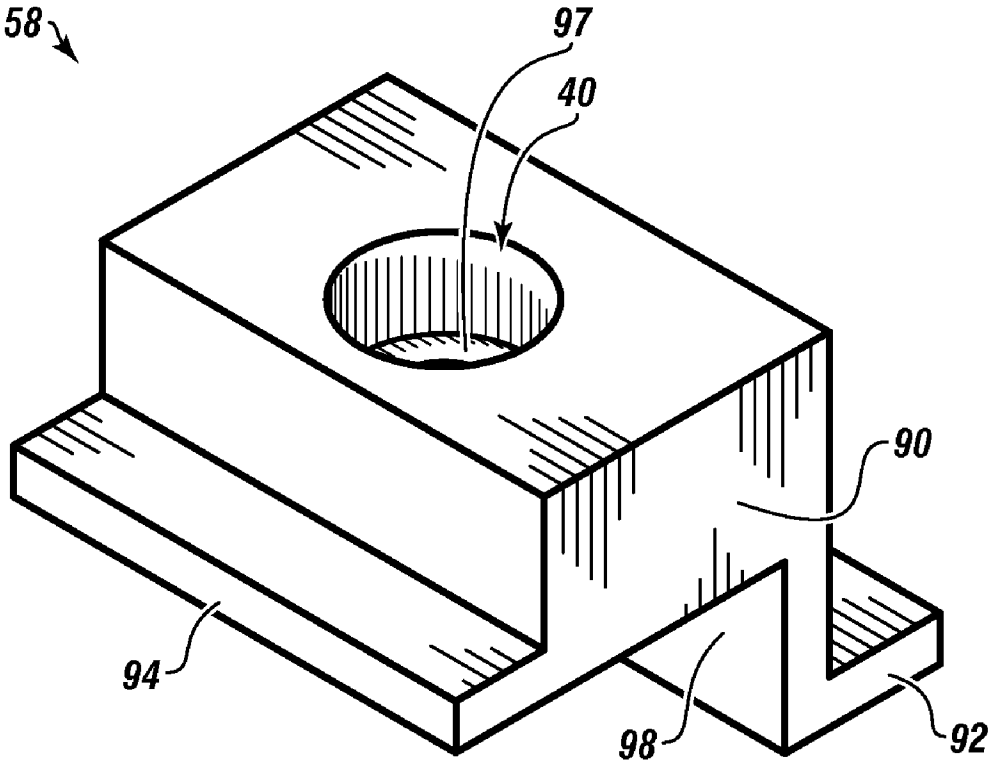
FIG. 6 shows an isometric view of a dual support connector.

FIG. 6 shows an isometric view of a dual support connector 58.

The dual support connector 58 is shown with connector body 90 with the connector hole 40, a connector structural panel flange 92, an integral flange support portion 98, and a connector glass panel flange 94. The connector glass panel flange 94 can be integral with the connector body 90. The connector stop 97 is also depicted.

Figure 7:
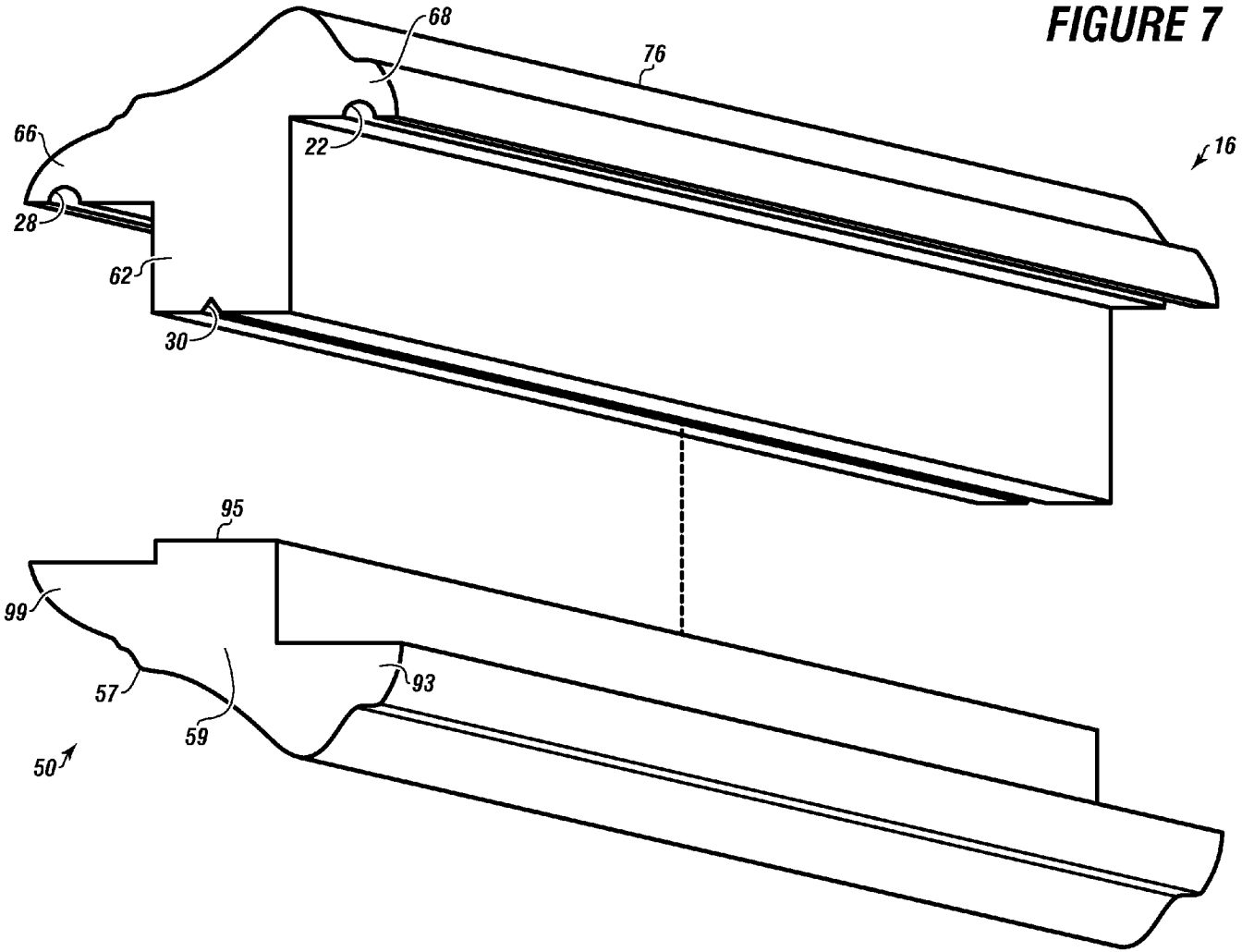
FIG. 7 depicts an isometric view of the exterior frame and the interior frame.

FIG. 7 depicts an isometric view of the exterior frame 16 and the interior frame 50.

The exterior frame 16 has decorative face 76, an exterior frame body portion 62, an exterior frame door flange 68, an exterior frame glass flange 66, a first gasket groove 22, a second gasket groove 28, and an alignment groove 30.

The interior frame 50 can have an interior frame intermediate face 95, the interior frame door flange 93, the interior frame glass flange 99, the interior frame decorative face 57, and the interior frame body 59.

Figure 8:
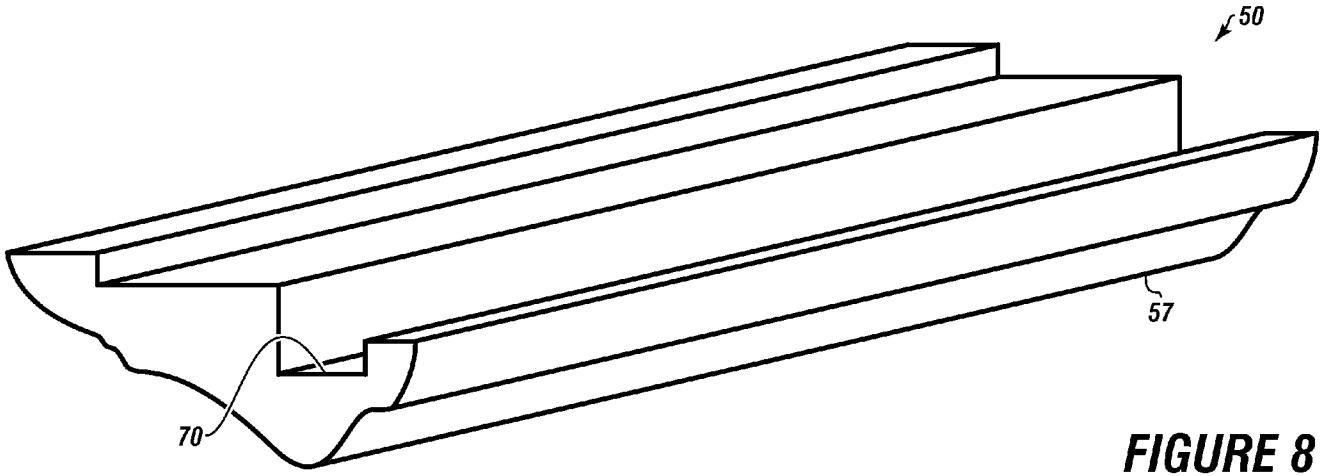
FIG. 8 depicts an isometric view of the interior frame.

FIG. 8 depicts an isometric view of another embodiment of the interior frame 50.

The interior frame 50 can have a connector groove 70 on an opposite side of the interior frame decorative face 57. The connector groove 70 provides a flush fit with the connector.

Figure 9:
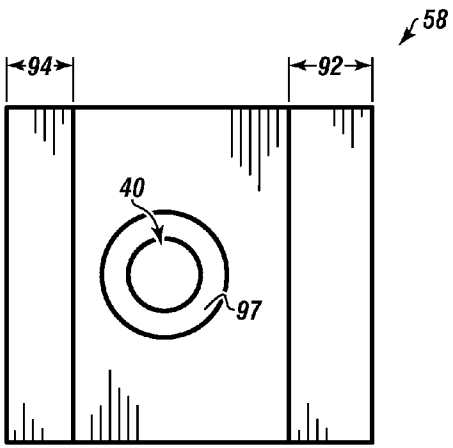
FIG. 9 depicts a top view of the dual support connector with the connector hole and a connector stop for preventing the head of a fastener from passing through the connector hole.

FIG. 9 depicts a top view of the dual support connector 58 with the connector hole 40 and a connector stop 97 for preventing the head of a fastener from passing through the connector hole.

The connector structural panel flange 92 is depicted wider than the connector glass panel flange 94.

FIG. 10A depicts a kit created to retrofit a glass panel into a door already installed at a field location, such as at a house, at a chemical plant, or at a retail establishment. FIG. 10B depicts an isometric view of a shipping clip and a shipping fastener used to ship the kit.

Referring to FIGS. 10A and 10B, the kit includes the interior frame 50, the exterior frame 16, the glass panel 12, a plurality of shipping clips 3*a*-3*d* for snugly holding the glass pane to the exterior frame. Also, shipping fasteners 101*a*-101*d* can secure the connectors to the exterior frame. A seal means can be preinstalled in the exterior frame 16 and the interior frame 50 to seal the glass to the frames.

A shipping fastener can be disposed through each shipping fastener hole, such as a shipping fastener hole 103*a*. Each shipping fastener has a shipping fastener hole formed in the shipping clip body 105*a*.

While these embodiments have been described with emphasis on the embodiments, it should be understood that within the scope of the appended claims, the embodiments might be practiced other than as specifically described herein.

What is claimed is:

1. A dual support connector assembly for connecting a glass panel to a structural panel for a door comprising:

a. a plurality of dual support connectors configured to engage the glass panel and the structural panel wherein each dual support connector comprises:
   (i) a connector body;
   (ii) a connector hole extending through the connector body, wherein the connector hole has a longitudinal axis;
   (iii) a connector structural panel flange integral with the connector body and extending at a right angle to the longitudinal axis of the connector hole away from the connector body for overlaying a structural edge of the structural panel;
   (iv) a connector glass panel flange integral with the connector body and extending at a right angle to the longitudinal axis of the connector hole away from the connector body for overlaying a glass portion of the glass panel;

b. a fastener for insertion into each connector hole;

c. an interior frame connectable to an interior portion of a glass edge portion of the glass panel and a panel edge portion of the structural panel, wherein the interior frame covers the plurality of dual support connectors;

d. a first fastening means for connecting the interior frame to the glass edge portion, and a second fastening means for connecting the interior frame to the panel edge portion;

e. an exterior frame configurable on an exterior portion of the structural panel for receiving the fastener but spaced apart from the connector body, wherein the exterior frame comprises:

(i) an exterior frame body portion at least partially disposed between the glass panel and the structural panel and for providing an engagement with the dual support connectors;

(ii) a decorative face formed on the exterior frame;

(iii) an exterior frame door flange extending from the exterior frame body portion forming a portion of the decorative face;

(iv) a first seal groove in the exterior frame door flange opposite the decorative face;

(v) a first seal means disposed within the first seal groove forming a first seal with the structural edge of the structural panel;

(vi) an exterior frame glass flange extending from the exterior frame body portion opposite and in parallel with the exterior frame door flange forming a portion of the decorative face;

(vii) a second seal groove in the exterior frame glass flange opposite the decorative face;

(viii) a second seal means disposed within the second seal groove forming a second seal with the glass edge of the glass panel, wherein the exterior frame is engaged by each fastener in the connector holes, thereby connecting the exterior frame with the plurality of dual support connectors, securing the glass panel with the structural panel without requiring any holes to be placed in the structural panel.

2. The dual support connector assembly of claim 1, wherein the first seal means and the second seal means are a member of the group consisting of: gaskets, curable silicone sealant, cross linked elastomers, resins, adhesion promoters, natural rubber, synthetic rubbers, and combinations thereof.

3. The dual support connector assembly of claim 1, wherein the first fastening means and the second fastening means comprise a member of the group consisting of: double sided adhesive tape, an epoxy, a glue, and combinations thereof.

4. The dual support connector assembly of claim 1, wherein the fastener has a head and is a member of the group consisting of: a screw, a nail, and a bolt.

5. The dual support connector assembly of claim 4, wherein the connector hole comprises a connector stop disposed in the connector hole for restraining the head of the fastener in the connector hole.

6. A dual support connector assembly for securing a glass panel to a structural panel in a door assembly or window assembly, wherein the dual support connector assembly comprises:

a. a dual support connector configured to engage the glass panel and the structural panel, wherein the dual support connector comprises:

(i) a connector body;

(ii) a connector hole extending longitudinally through the connector body;

(iii) a connector glass flange integral with the connector body and extending at a right angle to a longitudinal axis of the connector hole away from the connector body for overlaying a glass edge portion of the glass panel;

(iv) a connector structural panel flange integral with the connector body and extending at a right angle to the longitudinal axis of the connector hole away from the connector body for overlaying a panel edge portion of the structural panel while in a plane apart from a plane of the connector glass flange;

b. a fastener for insertion into the connector hole;

c. an exterior frame configurable on an exterior portion of the structural panel for receiving the fastener but spaced apart from the connector body, wherein the exterior frame comprises:

(i) an exterior frame body disposed between the glass panel and the structural panel;

(ii) a decorative face formed on the exterior frame opposite the exterior frame body;

(iii) an exterior frame door flange extending at a right angle to the exterior frame body forming a portion of the decorative face;

(iv) a first seal groove in the exterior frame door flange opposite the decorative face;

(v) a first seal means disposed within the first seal groove forming a first seal with a structural edge of the structural panel;

(vi) an exterior frame glass flange extending at a right angle to the exterior frame body opposite and in parallel with the exterior frame door flange forming a portion of the decorative face;

(vii) a second seal groove in a plane spaced apart from a plane of the first seal groove, wherein the second seal groove is in the exterior frame glass flange opposite the decorative face; and (viii) a second seal means disposed within the second seal groove forming a second seal with a glass edge portion of the glass panel; and d. an interior frame connectable with an interior side of the glass panel and the structural panel, wherein the exterior frame is engaged by the fasteners in the connector holes, thereby connecting the exterior frame with the plurality of dual support connectors, securing the glass panel with the structural panel without requiring any holes to be placed in the structural panel.

7. The dual support connector assembly of claim 6, wherein the dual support connector comprises aluminum, wood, alloys of metal, polyurethane, polyester, polyvinyl chloride (PVC), acrylonitrile butadiene styrene copolymer, polyamide, styrene butadiene rubber copolymer, and combinations thereof.

8. The dual support connector of claim 6, further comprising an antistatic coating disposed on encapsulating the dual support connector.

9. The dual support connector of claim 6, further comprising a connector groove formed in the interior frame.

10. The dual support connector of claim 6, wherein the connector body is a strip having a length from 2 cm to 12 cm.

11. The dual support connector of claim 6, wherein the connector hole has a diameter from 1 mm to 6 mm and a depth from 3 mm to 12 mm.

12. The dual support connector of claim 11, wherein the connector hole comprises a connector stop for securing the fastener in the connector hole allowing the fastener to secure to the exterior frame.

13. The dual support connector of claim 6, wherein the connector structural panel flange and the connector glass panel flange have different thicknesses.

14. The dual support connector of claim 6, wherein the connector structural panel flange and the connector glass panel flange extend less than 50 percent of a length of the connector body away from the connector body.

* * * * *